US009879839B2

(12) United States Patent
Yang

(10) Patent No.: US 9,879,839 B2
(45) Date of Patent: Jan. 30, 2018

(54) LAMP APPARATUS FOR VEHICLE

(71) Applicant: Hyundai Motor Company, Seoul (KR)

(72) Inventor: Jeong Gyu Yang, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 171 days.

(21) Appl. No.: 14/940,604

(22) Filed: Nov. 13, 2015

(65) Prior Publication Data

US 2017/0074478 A1 Mar. 16, 2017

(30) Foreign Application Priority Data

Sep. 11, 2015 (KR) ..... 10-2015-0129041

(51) Int. Cl.
*F21S 8/10* (2006.01)

(52) U.S. Cl.
CPC ..... *F21S 48/1757* (2013.01); *F21S 48/1145* (2013.01); *F21S 48/1159* (2013.01); *F21S 48/1225* (2013.01); *F21S 48/1258* (2013.01); *F21S 48/1388* (2013.01)

(58) Field of Classification Search
CPC ..... F21S 48/1757; F21S 48/1145; F21S 48/1159; F21S 48/1225; F21S 48/1258; F21S 48/1388
USPC ..... 362/514, 517, 521, 538
See application file for complete search history.

(56) References Cited

U.S. PATENT DOCUMENTS

| | | | | |
|---|---|---|---|---|
| 7,364,332 B2 * | 4/2008 | Komatsu | ..... | F21S 48/1186 362/509 |
| 2007/0183166 A1 * | 8/2007 | Albou | ..... | F21V 11/16 362/514 |
| 2015/0124468 A1 * | 5/2015 | Reiners | ..... | F21S 48/1136 362/510 |

FOREIGN PATENT DOCUMENTS

| | | | |
|---|---|---|---|
| JP | 2005-228715 | A | 8/2005 |
| JP | 2005-234113 | A | 9/2005 |
| JP | 2005-347127 | A | 12/2005 |
| JP | 2006-085922 | A | 3/2006 |
| JP | 2012-141574 | A | 7/2012 |
| KR | 10-1999-0063152 | A | 7/1999 |
| KR | 10-2007-0025112 | A | 3/2007 |
| KR | 10-1220063 | | 1/2013 |

* cited by examiner

*Primary Examiner* — Laura Tso
(74) *Attorney, Agent, or Firm* — Mintz Levin Cohn Ferris Glovsky and Popeo, P.C.; Peter F. Corless

(57) ABSTRACT

A lamp apparatus for a vehicle is provided. The lamp apparatus includes a light source that is configured to irradiate light, a light variable unit that is configured to implement a low beam by reflecting the light irradiated from the light source and transform a portion of the light into a plurality of angles to be reflected. The lamp further includes a first optical lens disposed to reflect light by the light variable unit to be incident and collect the incident light to be irradiated to the front and a second optical lens that transforms the light into the plurality of angles and reflected by the light variable unit to be incident. The angle-transformed and incident light irradiates to the front by the first optical lens.

5 Claims, 5 Drawing Sheets

LAMP APPARATUS FOR VEHICLE

CROSS REFERENCE TO RELATED APPLICATION

The present application claims priority to Korean Patent Application No. 10-2015-0129041, filed Sep. 11, 2015, the entire contents of which is incorporated herein for all purposes by this reference.

BACKGROUND

1. Technical Field

The present invention relates to a lamp apparatus for a vehicle capable of increasing low beam efficiency upon irradiation of the low beam while implementing a low beam and a high beam.

2. Description of the Related Art

Generally, a lamp for a vehicle includes a back lamp, a brake lamp turned on when a driver engages a brake, a turn signal lamp, etc. In particular, a headlamp illuminates a road in front of a vehicle by irradiating light in the direction that the vehicle is traveling and provides visual information to a driver by irradiating light to a road in front of the vehicle when the vehicle is driven during low light conditions (e.g., at night). Additionally, as the driver secures a front vision at night, the driver may confirm other vehicles and obstacles on a road, such that safety driving decisions may be made.

However, when the headlamp irradiates light to a road in front of the vehicle to secure the front vision, light may be irradiated to approaching vehicles from the opposite side of the road and to preceding vehicles. For example, intense light is irradiated to the opposite vehicles and the preceding vehicles, causing a dangerous driving condition due to glare produced from the illumination. Therefore, upon irradiating light through the headlamp, the light needs to be irradiated as a low beam or a high beam based driving conditions or the surrounding driving situations.

The contents described as the related art have been provided merely for assisting in the understanding for the background of the present invention and should not be considered as corresponding to the related art known to those skilled in the art.

SUMMARY

An object of the present invention provides a lamp apparatus for a vehicle capable of implementing a low beam and a high beam, and in particular, increases light efficiency of a low beam upon irradiating the low beam. In one aspect, according to an exemplary embodiment, a lamp apparatus for a vehicle may include a light source that may be configured to irradiate light, a light variable unit configured to implement a low beam by reflecting light irradiated from the light source to and transform a portion of the corresponding light into a plurality of angles to be reflected. Furthermore, a first optical lens may be disposed to allow the light reflected by the light variable unit to be incident and may be configured to collect the incident light to be irradiated to the front. A second optical lens may be disposed to allow the light transformed into the plurality of angles and reflected by the light variable unit to be incident and may be configured to irradiate the angle-transformed and incident light to the front portion irradiated by the first optical lens.

In some exemplary embodiments, the lamp apparatus may further include a reflecting surface that may be disposed to allow the light transformed into the plurality of angles and reflected by the light variable unit to be incident and may be configured to reflect the light angle-transformed by the light variable unit to be irradiated to the second optical lens side. The light variable unit may be configured to include a fixed reflector configured to reflect the light irradiated from the light source to the first optical lens side and a variable reflector that may be tilted to a predetermined angle with respect to the fixed reflector and transform the light irradiated from the light source into a plurality of angles to be reflected. The light variable unit may further include a tilting driver connected to the variable reflector to tilt the variable reflector to a predetermined angle based on a selection of the low beam or the high beam.

The light variable unit may be configured to tilt the variable reflector to a predetermined angle with respect to the fixed reflector upon the irradiation of the low beam. Further, the light variable unit may maintain the variable reflector in a horizontal position relative to the fixed reflector upon the irradiation of the high beam to irradiate light in substantially the same direction. The light variable unit may be configured to reflect the light irradiated from the light source toward the front of the vehicle without being transformed into a plurality of angles to implement the high beam. The light irradiated from the light source may be changed to a specific pattern shape by a diffractive optical element (DOE) lens.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
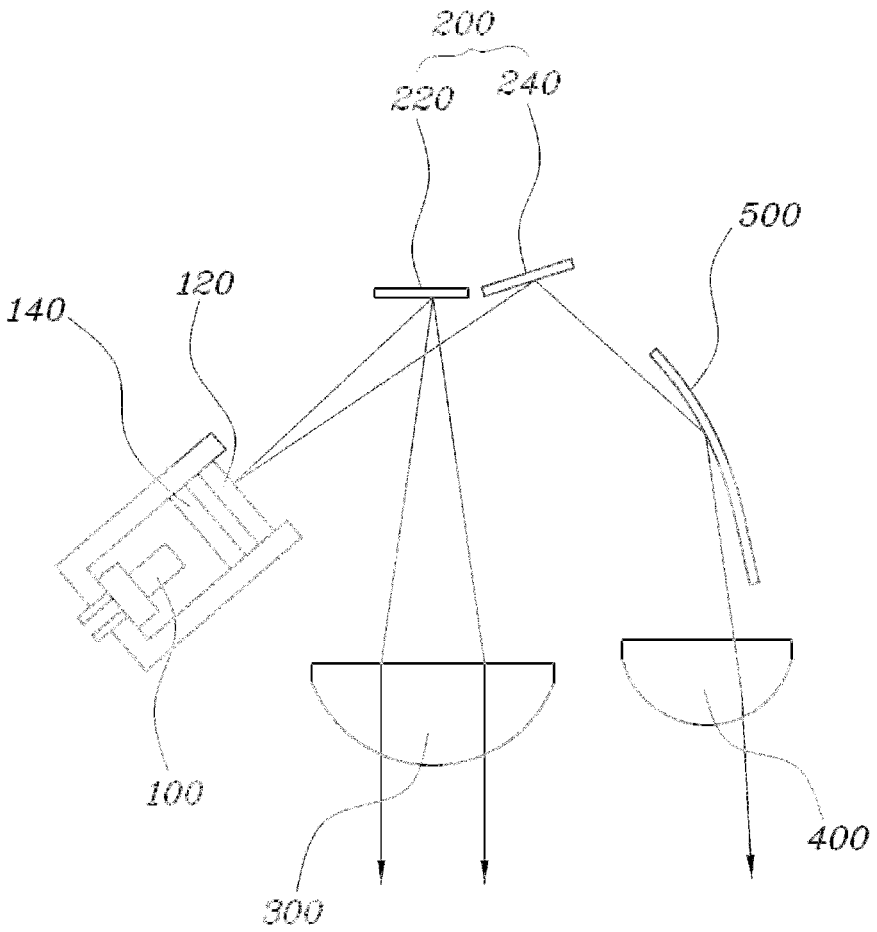
FIG. 1 is an exemplary view illustrating implementation of a low beam by a lamp apparatus for a vehicle according to an exemplary embodiment of the present invention.

While the present disclosure will be described in conjunction with exemplary embodiments thereof with reference to the accompanying drawings, the present description is not intended to limit the present invention to those exemplary embodiments. On the contrary, the invention is intended to cover not only the exemplary embodiments, but also various alternatives, modifications, equivalents and other embodiments, which may be included within the spirit and scope of the invention as defined by the appended claims. Throughout the drawings, the same reference numerals will refer to the same or like parts. Thus, components may be described with reference to several drawings.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Although an exemplary embodiment is described as using a plurality of units to perform the exemplary process, it is understood that the exemplary processes may also be performed by one or plurality of modules. Additionally, it is understood that the tem controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Figure 2:
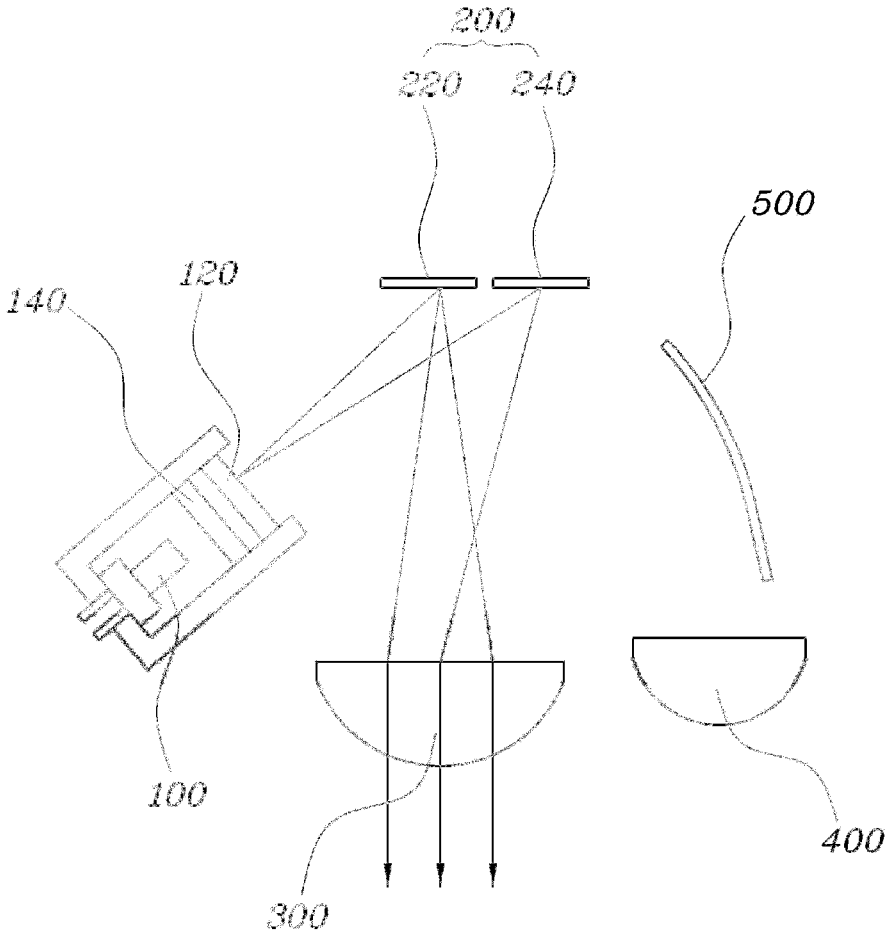
FIG. 2 is an exemplary diagram illustrating implementation of a high beam by the lamp apparatus for a vehicle illustrated in FIG. 1 according to an exemplary embodiment of the present invention.
Figure 3:
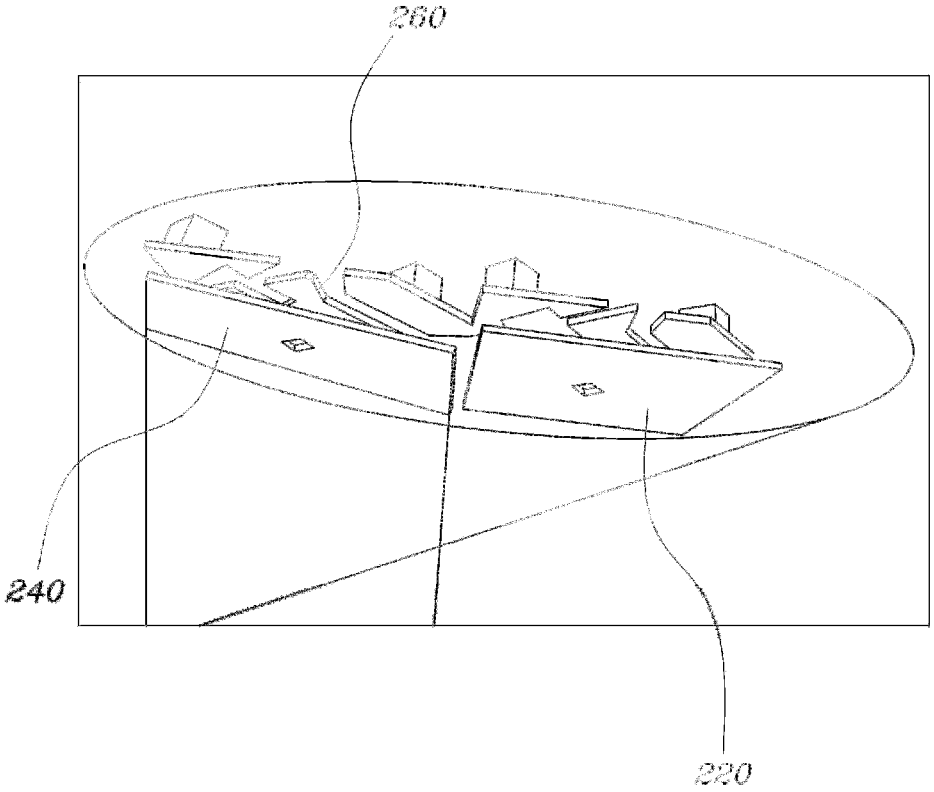
FIG. 3 is an exemplary diagram illustrating a light variable unit of the lamp apparatus for a vehicle illustrated in FIG. 1 according to an exemplary embodiment of the present invention.
Figure 4:
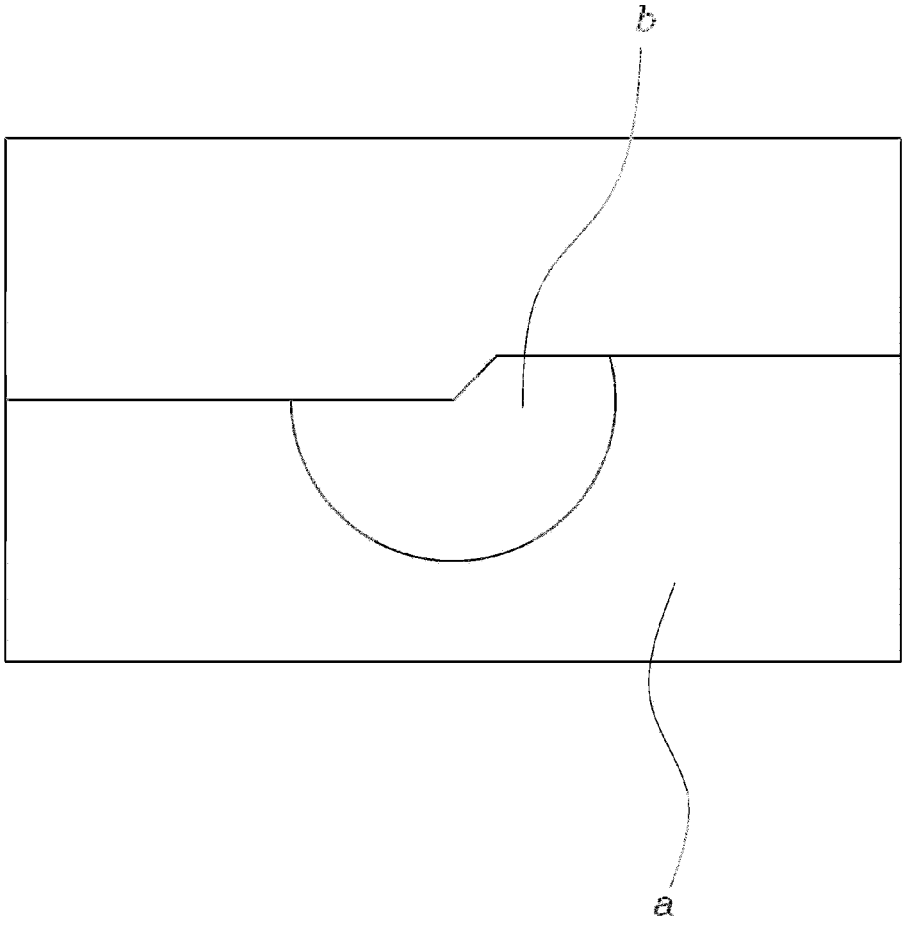
FIGS. 4 and 5 are exemplary diagrams for describing the lamp apparatus for a vehicle illustrated in FIG. 1 according to an exemplary embodiment of the present invention.
Figure 5:
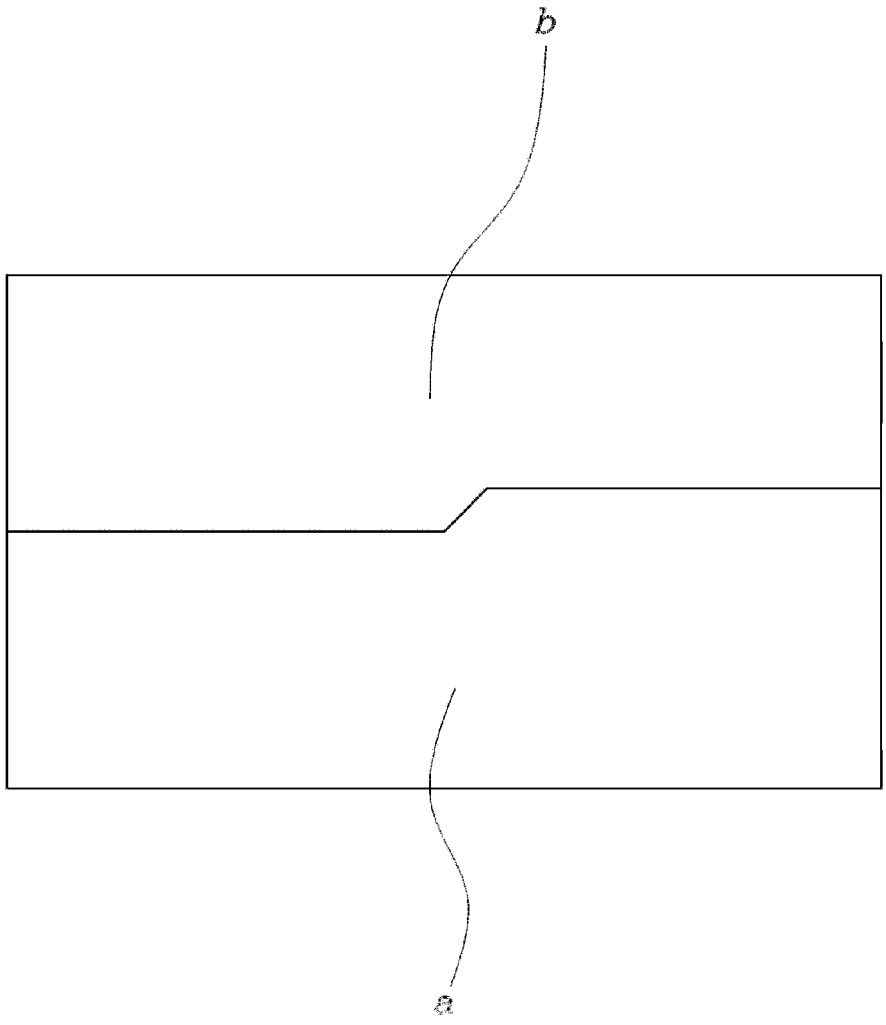

FIG. 1 is an exemplary a view illustrating an implementation of a low beam by a lamp apparatus for a vehicle according to an exemplary embodiment. FIG. 2 is an exemplary diagram illustrating an implementation of a high beam by the lamp apparatus for a vehicle illustrated in FIG. 1. FIG. 3 is an exemplary diagram illustrating a light variable unit of the lamp apparatus for a vehicle illustrated in FIG. 1. FIGS. 4 and 5 are exemplary diagrams for describing the lamp apparatus for a vehicle illustrated in FIG. 1.

As illustrated in FIG. 1, the lamp apparatus for a vehicle according to the exemplary embodiment may include a light source 100 configured to irradiate light, a light variable unit 200 configured to implement a low beam by reflecting light irradiated from the light source 100 and may transform a portion of the corresponding light into a plurality of angles to be reflected. The lamp apparatus may further include a first optical lens 300 disposed to receive the light reflected by the light variable unit 200 and configured to collect the incident light irradiated to the front and a second optical lens 400 disposed to receive the light transformed into the plurality of angles and reflected by the light variable unit 200. The lamp may be configured to irradiate the angle-transformed and incident light to the front irradiated by the first optical lens 300.

The lamp apparatus for a vehicle according to the exemplary embodiment may include the light source 100, the light variable unit 200, the first optical lens 300, and the second optical lens 400. For example as the light source 100, an LED may be applied and a phosphor 140 may transform a color of light irradiated from the light source 100. Further, a diffractive optical element (DOE) 120 lens may be applied to the light source 100 and the light irradiated from the light source 100 may be irradiated while being transformed to have a specific pattern shape. Additionally, the light variable unit 200 may be configured to reflect the light irradiated from the light source 100 to be irradiated to the front direction to implement a high beam or may be configured to transform a portion of the light into a plurality of angles to be reflected to implement a low beam based on a generation of invalid light.

As illustrated in FIG. 3, the light variable unit 200 may be configured to include a fixed reflector 220 configured to reflect the light irradiated from the light source 100 to the first optical lens 300 side and a variable reflector 240 that may be tilted to a predetermined angle with respect to the fixed reflector 220. Further, the light irradiated from the light source 100 may be transformed into a plurality of angles that may be reflected. For example, the fixed reflector 220 and the variable reflector 240 may be a plurality of digital micro-mirror device (DMD) chips and may be configured to select a high beam or a low beam based on a tilted angle of the variable reflector 240.

The light variable unit 200 may further include a tilting driver 260 connected to the variable reflector 240 to position (e.g., tilt) the variable reflector 240 in or at a predetermined angle based on the selection of the low beam or the high beam. In other words, the tilting driver 260 may be configured to turn on or off an electrical signal based on the driving situations. Further, the driving conditions of the vehicle may cause the variable reflector 240 to be positioned (e.g. tilt) to a predetermined angle. The light variable unit 200 based on the digital micro device is known in various related art documents and therefore the detailed description thereof will be omitted.

In particular, the fixed reflector 220 of the light variable unit 200 may allow the light irradiated from the light source 100 to be incident on the first optical lens 300. Further, the light irradiated from the light source 100 as the low beam may allow the light reflected from the fixed reflector 220 to be incident on the first optical lens 300. Additionally, the variable reflector 240 may be configured to be positioned (e.g., tilted) to a predetermined angle that may be adjacent to the fixed reflector 220. When the variable reflector 240 is positioned (e.g., tilted) to the predetermined angle with respect to the fixed reflector 220, the light may be irradiated from the light source 100 to the variable reflector 240, and the light may be transformed to a plurality of angles and may be reflected and thus may become invalid light.

However, the invalid light may be discarded upon the implementation of the low beam and therefore light efficiency may be reduced. According, to an exemplary embodiment, the light efficiency may be improved by using the invalid light. Namely, the lamp apparatus for a vehicle may include the second optical lens 400 that may be disposed to allow the light to be transformed into a plurality of angles and reflected by the light variable unit 200 to be incident and irradiate the angle-transformed and incident light to the front irradiated by the first optical lens 300. The lamp apparatus for a vehicle may include a reflecting surface 500 that may be disposed to transform the light into a plurality of angles and reflect the light by the light variable unit 200 to be incident. The light angle-transformed by the light variable unit 200 may be reflected to be irradiated to the second optical lens 400 side.

In other words, upon the implementation of the low beam, a portion of the light irradiated from the light source 100 may be transformed into the plurality of angles by the light variable unit 200. The reflecting surface 500 may be disposed at a position to which the light may be transformed into a plurality of angles. The light variable unit 200 and may be irradiated to reflect the corresponding light to be irradiated to the second optical lens 400 side. The invalid light may be transformed into a plurality of angles and may be reflected by the light variable unit 200 when irradiated in substantially the same direction as a direction in which light irradiates from the first optical lens 300 through the second optical lens 400. Therefore, a portion of the light irradiated from the light source 100 may be lost due to the reflection by the light variable unit 200 upon the implementation of the low beam. The portion of the lost light may be irradiated to the second optical lens 400 side through the reflecting surface 500, such that a light quantity may be sufficiently secured upon the irradiation of the low beam.

Moreover, the light variable unit 200 may be configured to reflect the light irradiated from the light source 100 toward the front portion without being transformed into different angles to implement the high beam. In other words, the variable reflector 240 may be positioned to be horizontal to the fixed reflector 220 upon the irradiation of the high beam so that the light irradiated from the light source 100 may be reflected to be irradiated in substantially the same direction. Therefore, a substantial portion of the light irradiated from the light source 100 may be incident on the first optical lens 300 and may be irradiated to the front, thereby implementing the high beam.

An operation of the lamp apparatus for a vehicle according to the exemplary embodiment as described above will be further described below. As illustrated in FIG. 1, a low beam may be implemented, when the variable reflector 240 of the light variable unit 200 may be positioned (e.g., tilted) to a predetermined angle. The light irradiated from the light source 100 may be reflected from the fixed reflector 220 to be incident on the first optical lens 300. At substantially the same time a portion of the light may reflected from the variable reflector 240 which may be adjusted (e.g., the tilt changed). Accordingly, the light reflected from the variable reflector 240 may be reflected from the reflecting surface 500 to be incident on the second optical lens 400 disposed at the front portion, such that light may be irradiated to a road surface through the first optical lens 300 and the second optical lens 400.

Therefore, as illustrated in FIG. 4, when a light quantity irradiated from the first optical lens 300 and a light quantity b irradiated from the second optical lens 400 are added, the light quantity may be sufficiently secured upon the irradiation of the low beam, thereby improving the light efficiency.

Furthermore, as illustrated in FIG. 2, upon implementation of implement the high beam, when the variable reflector 240 of the light variable unit 200 may be disposed to be horizontal position to the fixed reflector 220, the light irradiated from the light source 100 may be reflected from the fixed reflector 220 and the variable reflector 240. Accordingly, a substantial portion of the light may incident on the first optical lens 300. Therefore, as illustrated in FIG. 5, as a substantial portion of the light irradiated from the light source 100 may be reflected through the fixed reflector 220 and the variable reflector 240 may be incident on the first optical lens 300. Additionally light may be to irradiated up to portions where light is not irradiated by the variable reflector 240, thereby implementing the high beam.

In particular, according to the exemplary embodiment, when vehicles positioned opposite to each other or preceding vehicles are present in front of the vehicle and subjected to the irradiation of the high beam, the low beam or the high beam may be implemented. For example, the angle of the variable reflector 240 may be adjusted to prevent light from being directly irradiated to the front vehicle and the tilting angle of the variable reflector 240 may be set to be a specific angle and then a partial obstruction of the light may occur.

According to the lamp apparatus for a vehicle having the structure as described above, the light efficiency of the low beam may be increased by using the invalid light upon the irradiation of the low beam while simultaneously implementing the high beam and the low beam with the single light source 100. Additionally, the performance of the headlamp may be improved by reutilizing the light discarded upon the implementation of the low beam.

Although the present invention has been shown and described with respect to specific exemplary embodiments, it will be obvious to those skilled in the art that the present invention may be variously modified and altered without departing from the spirit and scope of the present invention as defined by the following claims.

What is claimed is:

1. A lamp apparatus for a vehicle, comprising:

a light source configured to irradiate light;

a light variable unit configured to implement a high beam and a low beam by reflecting the light irradiated from the light source, the light variable unit being configured to reflect the light into a plurality of angles;

a first optical lens configured to irradiate an incident light to a front of the lens, the incident light being the light reflected by the light variable unit with an angle; and a second optical lens configured to irradiate another incident light to the front, the incident light being the light reflected by the light variable unit with another angle different from the angle of the incident light on the first optical lens, wherein the light variable unit includes a fixed reflector configured to reflect the light irradiated from the light source to the first optical lens side and a variable reflector disposed to a predetermined angle with respect to the fixed reflector to transform the light irradiated from the light source into the plurality of angles to be reflected, and wherein the light variable unit is configured to adjust the variable reflector to the predetermined angle with respect to the fixed reflector upon the irradiation of the low beam and position the variable reflector horizontal to the fixed reflector upon the irradiation of a the high beam to irradiate light in the same direction.

2. The lamp apparatus of claim 1, further comprising:

a reflecting surface configured to reflect the light with the another angle to the second optical lens.

3. The lamp apparatus of claim 1, wherein the light variable unit further includes a tilting driver connected to the variable reflector to position the variable reflector to the predetermined angle based on a selection of the low beam or the high beam.

4. The lamp apparatus of claim 1, wherein the light variable unit reflects substantially all the light irradiated from the light source toward the front to implement a high beam.

5. The lamp apparatus of claim 1, wherein the light irradiated from the light source is changed to a specific pattern shape.

* * * * *